US009841201B2

(12) United States Patent
Saffre et al.

(10) Patent No.: US 9,841,201 B2
(45) Date of Patent: Dec. 12, 2017

(54) METHOD AND SYSTEM FOR LIMITING CONSUMPTION

(71) Applicants: Khalifa University of Science, Technology, and Research, Abu Dhabi (AE); British Telecommunications plc, London (GB); Emirates Telecommunications Corporation, Abu Dhabi (AE)

(72) Inventors: Fabrice Saffre, Ipswich (GB); Mark Shackleton, Ipswich (GB); Hanno Hildmann, Abu Dhabi (AE); Sébastien Matthieu René Nicolas, Abu Dhabi (AE)

(73) Assignees: Khalifa University of Science, Technology and Research, Abu Dhabi (AE); British Telecommunications PLC, London (GB); Emirates Telecommunications Corporation, Abu Dhabi (AE)

( * ) Notice: Subject to any disclaimer, the term of this patent is extended or adjusted under 35 U.S.C. 154(b) by 795 days.

(21) Appl. No.: 14/104,416

(22) Filed: Dec. 12, 2013

(65) Prior Publication Data

US 2015/0167997 A1 Jun. 18, 2015

(51) Int. Cl.
*F24F 11/00* (2006.01)

(52) U.S. Cl.
CPC ... *F24F 11/0009* (2013.01); *F24F 2011/0075* (2013.01)

(58) Field of Classification Search
CPC .... F24F 11/0009–11/006; F24F 11/001; F24F 2011/0047–2011/0075;
(Continued)

(56) References Cited

U.S. PATENT DOCUMENTS 4,897,798 A 1/1990 Cler
2004/0255601 A1 12/2004 Kwon et al.
(Continued)

FOREIGN PATENT DOCUMENTS

EP 0852331 7/1998
GB 2448896 11/2008
(Continued)

OTHER PUBLICATIONS

Hill, D.J., Liu, T., Verbic, G., Smart grids as distributed learning control, The IEEE Power and Energy Society General Meeting (PES 2012), Jul. 22-26, 2012, p. 1-8.*
(Continued)

*Primary Examiner* — Sean Shechtman
*Assistant Examiner* — Shon Foley
(74) *Attorney, Agent, or Firm* — Calfee, Halter & Griswold, LLP

(57) ABSTRACT

This invention relates to methods and systems for limiting consumption, particularly power consumption, more particularly by appliances in a building, and is generally suitable for integration with building management systems. Embodiments of the invention provide arrangements in which the aggregated power load of a plurality of appliances is capped to a selected value (which may be arbitrary, or may be dictated by conditions) while seeking to minimize the deviation from target environmental conditions within the building through a combination of distributed decision making by the appliances themselves and centralized orchestration, which may be informed by real-time sensor readings and/or known properties of the building. The distributed decision-making by individual devices may be based on projected deviation from the target conditions after a period of activity or inactivity but with a central controller which determines which devices should be switched on.

10 Claims, 2 Drawing Sheets

(58) Field of Classification Search
CPC ..... F24F 11/0034; G05B 2219/2614; G05D 23/1923; H02J 3/14
USPC ..... 700/276
See application file for complete search history.

(56) References Cited

U.S. PATENT DOCUMENTS

| | | | | |
|---|---|---|---|---|
| 2005/0222715 | A1 | 10/2005 | Ruhnke | |
| 2010/0163633 | A1* | 7/2010 | Barrett | B60H 1/00871 236/49.3 |
| 2010/0211224 | A1 | 8/2010 | Keeling et al. | |
| 2010/0217450 | A1* | 8/2010 | Beal | H02J 3/14 700/291 |
| 2011/0184581 | A1* | 7/2011 | Storch | G06Q 10/06 700/295 |
| 2013/0066482 | A1* | 3/2013 | Li | H02J 3/14 700/297 |
| 2013/0085614 | A1* | 4/2013 | Wenzel | F24F 11/006 700/277 |
| 2013/0218360 | A1* | 8/2013 | Najewicz | G05B 15/02 700/294 |
| 2013/0282181 | A1* | 10/2013 | Lu | H02J 3/14 700/275 |
| 2014/0018971 | A1* | 1/2014 | Ellis | G06Q 10/04 700/297 |
| 2014/0096946 | A1* | 4/2014 | Rognli | F24F 11/006 165/209 |

FOREIGN PATENT DOCUMENTS

| | | |
|---|---|---|
| KR | 100751834 | 8/2007 |
| WO | 2009/122173 | 10/2009 |
| WO | 2012093324 | 7/2012 |

OTHER PUBLICATIONS

"Occupancy Based Deman Response HVAC Control Strategy" by Erickson et al., BuildSys, Nov. 2, 2010.
"Introduction to Commercial Building Control Strategies and Techniques for Demand Response" by Motegi et al., Demand Response Research Center, May 22, 2007.
"Critical Infrastructure Protection through Distributed Reactive Demand-Side Management" by Hildmann et al., 6th International Conference on Internet Technology and Secured Transactions, Dec. 11-14, 2011, Abu Dhabi, United Arab Emirates.
"Influence of Variable Supply and Load Flexibility on Demand-Side Management" by Hildmann et al., 8th International Conference on the European Energy Market (EMM), May 25-27, 2011, Zagreb, Croatia.
"Simulating stochastic activation functions" by Hildmann et al. Conference Aug. 20-23, 2013.
"Modeling Quality of Service vs Peak Reduction trade-offs in A/C-based Demand-Side Management" by Saffre et al., IEEE First International Workshop on Smart Grid Modeling and Simulation (SGMS) at IEEE SmartGridComm 2011.
"Demand-Side Management for Air Conditioning" by Hildmann et al., 6th International Conferenece on Internet Technology and Secured Transactions, Dec. 11-14, 2011, Abu Dhabi, United Arab Emirates.
International Search Report dated Aug. 7, 2014, for International Application Serial No. PCT/GB2013/053275.
Written Opinion dated Aug. 7, 2014, for International Application Serial No. PCT/GB2013/053275.

* cited by examiner

METHOD AND SYSTEM FOR LIMITING CONSUMPTION

FIELD OF THE INVENTION

The present invention relates to methods and systems for limiting consumption, particularly power consumption. It is particularly, but not exclusively, concerned with limiting power consumption of climate control devices in a building whilst maintaining a certain level of comfort within the building.

BACKGROUND OF THE INVENTION

Building Management Systems (BMS) are well established and are used to control heating and air conditioning (AC) infrastructure so as to ensure the comfort of building inhabitants as well as to achieve other goals such as cooling of ICT equipment. In the business and corporate environment, BMS are available that can be used to obtain sensor data and set control values such as thermostat set points, remotely (e.g. see: www.trendcontrols.com).

In tandem with this, energy savings (and associated cost savings) have become an important goal in recent years. Clearly there can be a trade-off between energy saving and controlling temperature using HVAC (heating, ventilation and air-conditioning) systems under BMS control. For example, reducing a thermostat setting by one degree in the UK winter will save energy, but it will typically lead to a higher percentage of dissatisfied building inhabitants.

The broader context of energy saving is energy management (EM). Here the goal is not just to reduce energy but rather to manage the consumption of energy over time to achieve certain goals. Specifically techniques such as Demand Side Management (DSM) or Demand Response (DR) can be used to time-shift energy consumption, typically to avoid peaks in energy consumption, so as to help balance energy consumption with available energy supply. Peak periods of energy consumption in the UK and many other countries equate to more costly energy generation, so reduction of demand peaks (which would otherwise exceed normally available supply) can result in avoiding buying energy at the most costly time or can result in being paid revenue by the energy provider or networks (National Grid in the UK) so that they can similarly avoid direct costs themselves. An example of this is UK National Grid's Short Term Operating Reserve (STOR) scheme.

Note that when applying climate control to buildings there is a desire to control "thermal comfort" which has been defined by the American Society of Heating, Refrigerating and Air-Conditioning Engineers (ASHRAE). A model for thermal comfort is captured in terms of PMV (predicted mean vote) and PPD (predicted percent dissatisfied) measures via equations defined in ISO 7730. This model has been used, with respect to temperature variability, to inform the measure of temperature-drift-related discomfort discussed later.

The Demand Response Research Center (DRRC, Lawrence Berkeley National Laboratory) has published a comprehensive report "Introduction to Commercial Building Control Strategies and Techniques for Demand Response," which can be found at gaia.lbl.gov.

This guide gives a good summary of available approaches and in particular discusses the following DR strategies for HVAC systems:

Global Temperature Adjustment of Zones

Systemic Adjustments to the Air Distribution and/or Cooling Systems.

Section 3.4.1 of this report states that: "Demand limit strategy is a supervisory control algorithm that manages a combination of single or multiple DR control strategies. When the whole building demand exceeds a warning level, the EMCS deploys strategy #1. If the whole building demand still exceeds the warning level, strategy #2 is deployed, and so on. Thus, whenever the demand hits the warning level, the whole building demand is suppressed by a combination of sequential strategies. Strategies that have a lower impact on occupants' comfort should come first, and strategies that have more impact should come later. When the demand goes below the lower deadband level, the last strategy should be deployed. For any strategy that may have a risk of causing a rebound peak, slow recovery strategies must be considered.

Demand limit strategy has been considered as a method to avoid high demand charges during normal operation, rather than as a demand response strategy. However, depending on the structure of demand response programs, demand limit strategy can be a very useful tool to achieve desired kW savings. For example, demand bidding programs offered by many utility companies require curtailing a preset kW demand against a baseline defined by each utility. If the EMCS has a function to develop dynamic demand limit setpoints based on the baseline, the demand limit target can be set as shown in Equation 1, so that the desired demand savings can always be achieved.

$$\text{[Demand limit target]}=\text{[Baseline]}-\text{[Desired demand savings]}" \qquad \text{Equation 1:}$$

Control of HVAC units/infrastructure has been proposed that is sensitive to occupancy of buildings. E.g. "Occupancy Based Demand Response HVAC Control Strategy," which can be found at andes.ucmerced.edu. This can help promote energy saving but does not seek to meet a specific energy cap.

It is an object of the present invention to provide systems and methods in which the aggregated power load of a plurality of appliances is capped to a selected value (which may be arbitrary, or may be dictated by conditions) whilst seeking to minimize the deviation from target environmental conditions.

It is a further object of the present invention to provide a building management system, a method of operation and individual climate control appliances which provide for enhanced flexibility of appliance operation with a guarantee that the total load will not exceed a certain "cap".

Whilst the aims of the present invention are most relevant to commercial buildings, they could in principle be applied in a residential context too, where the goal might be to meet an energy cap across a number of rooms or more likely a number of households. In the latter case it might be part of a lower tariff energy package where DR is permitted by a householder so as to have a better deal on energy costs.

Aspects of the present invention could also be used to help identify and prioritise which rooms or areas within a building which could have reduced A/C (or heating, or other climate control) whilst still maintaining an acceptable temperature range, thereby contributing into a DR/DSM scheme.

SUMMARY OF THE INVENTION

An exemplary embodiment of the invention provides a method of limiting power consumption in a plurality of climate control appliances, each of which is communicably coupled to a controller, the climate control appliances having a running cycle of predetermined length, the method including the steps of: setting a cap for the total power consumption of the appliances; setting a set point for a climate parameter for each climate control appliance; and before the end of each running cycle, each climate control appliance: measuring a climate parameter associated with the area around said climate control appliance; predicting whether said appliance being active for the next running cycle will result in the climate parameter being closer to the set point for said appliance than if said appliance is inactive for the next running cycle; and if it is predicted that said appliance being inactive results in the climate parameter being closer to the set point, maintaining said appliance in an inactive state for the next running cycle; if it is predicted that said appliance being active results in the climate parameter being closer to the set point, said appliance communicating with the controller to request permission to be in an active state for the next running cycle; the controller: selecting some or all of said appliances which have requested permission to be active for the next running cycle such that said cap is not exceeded and taking account of the predicted deviation of each appliance from its set point if it is not activated; and communicating with said selected appliances to cause them to be active for the next running cycle.

A further exemplary embodiment of the invention provides a climate control appliance which is communicably coupled to a controller and has a running cycle of predetermined length, the climate control appliance having a processor which is arranged to: store a set point for a climate parameter associated with said appliance; before said climate control appliance reaches the end of each running cycle: measure a climate parameter associated with the area around said climate control appliance; predict whether said appliance being active for the next running cycle will result in the climate parameter being closer to the set point for said appliance than if said appliance is inactive for the next running cycle; and if it is predicted that said appliance being inactive results in the climate parameter being closer to the set point, maintain said appliance in an inactive state for the next running cycle; if it is predicted that said appliance being active results in the climate parameter being closer to the set point, communicate with the controller to request permission to be in an active state for the next running cycle and receive from the controller a communication regarding the activation of the appliance for the next running cycle and set the status of the appliance for that running cycle accordingly.

A further exemplary embodiment of the invention provides a building management system comprising a plurality of climate control appliances communicably coupled to a controller, each of the climate control appliances having a running cycle of predetermined length and a processor which is arranged to: store a set point for a climate parameter associated with said appliance; before said climate control appliance reaches the end of each running cycle: measure a climate parameter associated with the area around said climate control appliance; predict whether said appliance being active for the next running cycle will result in the climate parameter being closer to the set point for said appliance than if said appliance is inactive for the next running cycle; and if it is predicted that said appliance being inactive results in the climate parameter being closer to the set point, maintain said appliance in an inactive state for the next running cycle; if it is predicted that said appliance being active results in the climate parameter being closer to the set point, communicate with the controller to request permission to be in an active state for the next running cycle and receive from the controller a communication regarding the activation of the appliance for the next running cycle and set the status of the appliance for that running cycle accordingly, and wherein the controller is arranged to: store a cap for the total power consumption of the appliances; select some or all of said appliances which have requested permission to be active for the next running cycle such that said cap is not exceeded and taking account of the predicted deviation of each appliance from its set point if it is not activated; and communicate with said selected appliances to cause them to be active for the next running cycle.

BRIEF DESCRIPTION OF THE DRAWINGS

Embodiments of the invention will now be described by way of example with reference to the accompanying drawings in which.

DETAILED DESCRIPTION

Figure 1:
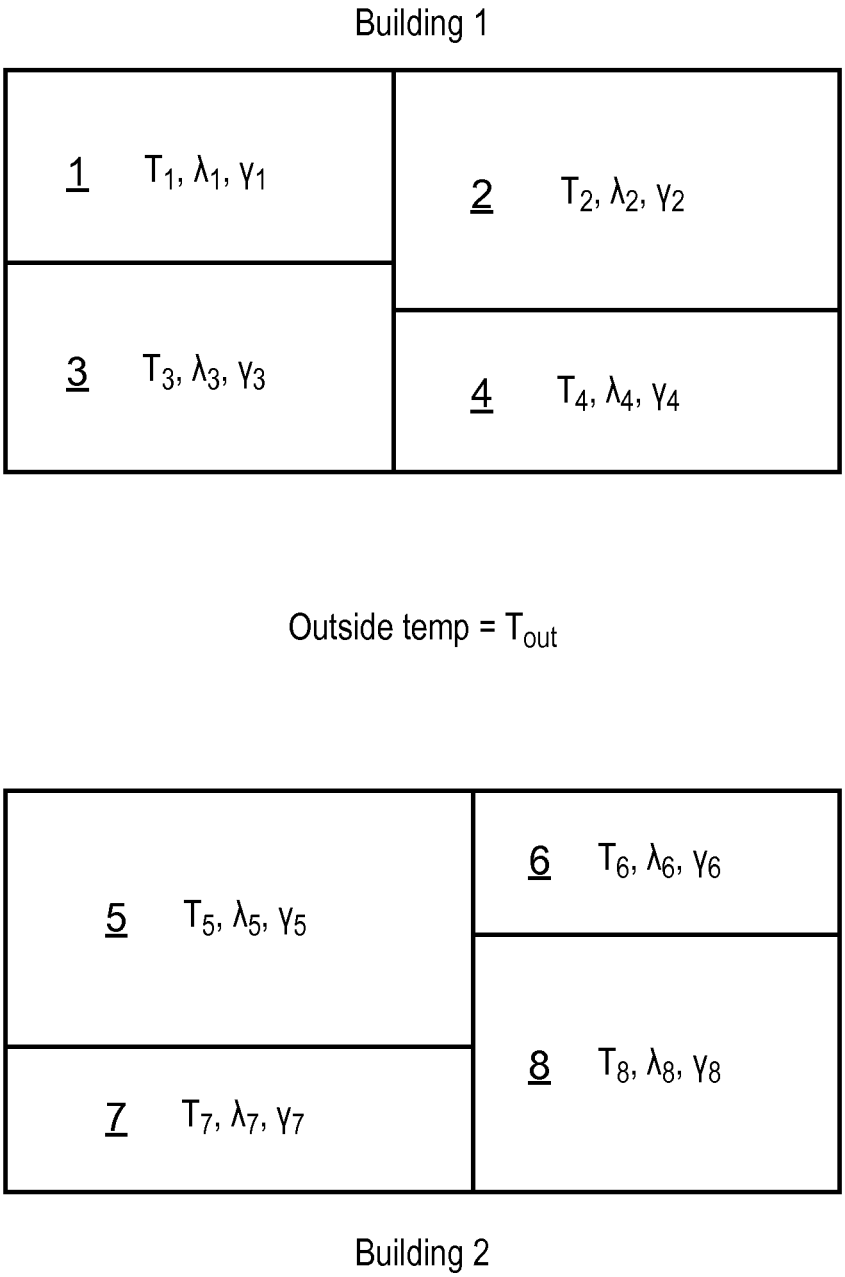
FIG. 1 shows a set of rooms under the control of a building management system according to an embodiment of the present invention.

At their broadest, methods of the present invention provide a method of limiting power consumption of climate control appliances to a selected capped value whilst reducing the deviation from target environmental conditions in the areas served by those appliances.

A first aspect of the present invention provides a method of limiting power consumption in a plurality of climate control appliances, each of which is communicably coupled to a controller, the climate control appliances having a running cycle of predetermined length, the method including the steps of: setting a cap for the total power consumption of the appliances; setting a set point for a climate parameter for each climate control appliance; and before the end of each running cycle, each climate control appliance: measuring a climate parameter associated with the area around said climate control appliance; predicting whether said appliance being active for the next running cycle will result in the climate parameter being closer to the set point for said appliance than if said appliance is inactive for the next running cycle; and if it is predicted that said appliance being inactive results in the climate parameter being closer to the set point, maintaining said appliance in an inactive state for the next running cycle; if it is predicted that said appliance being active results in the climate parameter being closer to the set point, said appliance communicating with the controller to request permission to be in an active state for the next running cycle; the controller: selecting some or all of said appliances which have requested permission to be active for the next running cycle such that said cap is not exceeded and taking account of the predicted deviation of each appliance from its set point if it is not activated; and communicating with said selected appliances to cause them to be active for the next running cycle.

The climate parameter may be, for example, temperature, humidity or airflow. The climate control appliances may be, for example, heaters, chillers, air conditioning units, humidifiers, driers, air vents, or controllable window blinds.

By using a projection-based decision mechanism to determine the climate control appliances which are to be activated, it is possible to reduce or avoid unnecessarily "overshooting" of the set-point for any particular climate control appliance (which could result in both energy waste and discomfort). The projections made may take account of (inferable) thermal parameters of heat loss/gain rates from the area surrounding each appliance.

The method of this aspect can make use of dynamic and fine-grained local decision-making, informed by real-time sensor readings. This means that the method can take into account special, changing and/or unforeseen circumstances in individual rooms or areas, which cannot be done by applying a sequence of pre-calculated policies.

In a development of this aspect, as well as setting a power cap, it is also possible to set a discomfort threshold which if breached could be used to alert a central or wider building management system to enact other demand reduction strategies, which may include a general, or local relaxation of the cap.

The method of this aspect combines enhanced flexibility with a guarantee that the total load will not exceed a certain "cap" (limit or budget) by operating a two-level orchestration method. All local decisions can be aggregated and reviewed by a centralized controller with the authority to allow or deny activation of individual climate-control appliances. In effect, this secondary decision level can maintain and enforce what amounts to a dynamic, fully customizable policy taking into account local requirements yet simultaneously achieving a global target.

This method can be usefully included within a Demand Response (DR/DSM) context, since it provides a guaranteed cap of power consumption that which, once set, will not be exceeded by the system. The cap can also be dynamically adjusted if desired to meet time varying supply-side constraints.

Overall the method of the present aspect is likely to lead to some overall energy savings as the climate parameter is allowed to drift during periods of power capping, reducing total consumption by the appliances. After applying the method of this aspect for some time it may be discovered that apparent discomfort is in fact at an acceptable level in some zones, which could lead to longer term adjustments and energy savings becoming possible.

As it is based at an appliance level, the method of the present aspect can take into account the influence of external factors and variables (e.g. temperature) on the priority level of "competing" processes. By contrast, in the prior art, typically only the aggregated load/price was taken into consideration to determine if a particular process/load was allowed to start.

In a preferred embodiment, the step of selecting includes the sub-steps of: determining the total number of said appliances requesting permission to be in an active state for the next running cycle and checking whether said cap is exceeded with all such appliances being in an active state; if it is not, communicating with each appliance requesting permission to cause said appliances to be active for the next running cycle; if it is, determining a subset of said appliances which can be active such that the cap is not exceeded and the overall deviation of said climate parameters from said set points is minimized and communicating with said subset of appliances to cause the appliances in said subset to be active for the next running cycle.

In a development of the above preferred embodiment the step of determining a subset of said appliances includes the sub-steps of: determining the number of said appliances which can be active without exceeding said cap; selecting, from the appliances requesting permission, the appliance whose predicted climate parameter at the end of the next running cycle if the appliance is inactive is furthest from the set point for said appliance, and adding said appliance to the subset; and repeating said selection for the remaining appliances requesting permission until the number of appliances in said subset has reached said determined number which can be active without exceeding said cap.

The method of the above development is preferred over a combinatorial approach that attempts to consider the effect of all possible permutations of appliance activation as it is considerably simpler and therefore more efficient both computationally and in terms of time taken.

The method may further include the steps of: determining the occupancy of an area served by at least one of said climate control appliances; and either: setting said set point for said appliance based on said determination of occupancy, or taking said occupancy into account when selecting if said appliance is to be active for the next running cycle. By determining the occupancy of an area or zone, it may be possible to identify areas or zones for which the climate control is not currently necessary. These zones could be given lower local caps, or given lower preference when determining the subset of appliances to be active in the next cycle (at one extreme, all appliances in that area could be switched off) and the remaining occupied zones have their caps increased accordingly. Alternatively the set point for appliances in zones with no occupancy could be set to a minimal level, such that demands to be active from such appliances are infrequent.

The method may further include the step of adjusting said cap for one or more of said groups of appliances or removing said cap for one or more of said groups of appliances by incrementally increasing said cap over a predetermined period of time. In this way, the method may allow for a controlled relaxation of the cap. For example, after a period of power capping, the cap may be removed entirely. However, it may be desirable to avoid a rapid "rebound" which may result in an energy demand spike as a result of all (or a large proportion) of appliances switching on as soon as the cap is removed. Therefore the method may be arranged to remove a cap in stages by adjusting the capping level over a period of time.

The cap may be dynamically adjusted to match the demand level of said plurality of climate control appliances to a time-varying power supply level. A particular implementation of this would be to dynamically match demand levels to time-varying changes in supply levels from local renewable sources. The output from renewable energy sources (e.g. solar panels, wind generators) can be very variable and matching demand levels to those supply levels by dynamically varying the cap applied can maximise the use of those sources.

The method of the present aspect may include any combination of some, all or none of the above described preferred and optional features.

The methods of the above aspect is preferably implemented by a climate control appliance according to the second aspect of this invention and/or in a building management system according to the third aspect of this invention, as described below, but need not be.

Further aspects of the present invention include computer programs for running on computer systems which carry out the methods of the above aspect, including some, all or none of the preferred and optional features of that aspect.

At their broadest, devices of the present invention provide climate control appliances which can be controlled to limit power consumption to a selected capped value whilst reducing the deviation from target environmental conditions in the areas served by the appliance.

A second aspect of the present invention provides a climate control appliance which is communicably coupled to a controller and has a running cycle of predetermined length, the climate control appliance having a processor which is arranged to: store a set point for a climate parameter associated with said appliance; before said climate control appliance reaches the end of each running cycle: measure a climate parameter associated with the area around said climate control appliance; predict whether said appliance being active for the next running cycle will result in the climate parameter being closer to the set point for said appliance than if said appliance is inactive for the next running cycle; and if it is predicted that said appliance being inactive results in the climate parameter being closer to the set point, maintain said appliance in an inactive state for the next running cycle; if it is predicted that said appliance being active results in the climate parameter being closer to the set point, communicate with the controller to request permission to be in an active state for the next running cycle and receive from the controller a communication regarding the activation of the appliance for the next running cycle and set the status of the appliance for that running cycle accordingly.

The climate parameter may be, for example, temperature, humidity or airflow. The climate control appliances may be, for example, heaters, chillers, air conditioning units, humidifiers, driers, air vents or controllable window blinds.

By using a projection-based decision mechanism carried out by the appliance itself to determine the climate control appliances which are to be activated, it is possible to reduce or avoid unnecessarily "overshooting" of the set-point for any particular climate control appliance (which could result in both energy waste and discomfort). The projections made may take account of (inferable) thermal parameters of heat loss/gain rates from the area surrounding each appliance.

The appliance of this aspect can feed in dynamic information, informed by real-time sensor readings to the controller to allow fine-grained local decision-making in the context of the overall building management system of which the appliance may form part. This means that special, changing and/or unforeseen circumstances in individual rooms or areas can be taken into account, which cannot be done by applying a sequence of pre-calculated policies.

By carrying out the prediction at an appliance level, the appliance of the present aspect can take into account the influence of external factors and variables (e.g. temperature) on the priority level of "competing" processes and feed this information into the overall decision making process. By contrast, in the prior art, typically only the aggregated load/price was taken into consideration to determine if a particular process/load was allowed to start.

The climate control appliance may further include an occupancy determination sensor which is arranged to determine the occupancy of an area served by said climate control appliance, and wherein the processor is further arranged to set said set point for said appliance based on said determination of occupancy. By determining the occupancy of an area or zone, it may be possible to identify areas or zones for which the climate control is not currently necessary. These zones could be given lower local caps, or given lower preference when determining the subset of appliances to be active in the next cycle (at one extreme, all appliances in that area could be switched off) and the remaining occupied zones have their caps increased accordingly. Alternatively the set point for appliances in zones with no occupancy could be set to a minimal level, such that demands to be active from such appliances are infrequent.

The climate control appliance of this aspect preferably operates by carrying out the relevant steps of a method according to the first aspect described above.

The climate control appliance of the present aspect may include any combination of some, all or none of the above described preferred and optional features.

At their broadest, systems of the present invention provide a system which limits the power consumption of climate control appliances to a selected capped value whilst reducing the deviation from target environmental conditions in the areas served by those appliances.

A third aspect of the present invention provides a building management system comprising a plurality of climate control appliances communicably coupled to a controller, each of the climate control appliances having a running cycle of predetermined length and a processor which is arranged to: store a set point for a climate parameter associated with said appliance; before said climate control appliance reaches the end of each running cycle: measure a climate parameter associated with the area around said climate control appliance; predict whether said appliance being active for the next running cycle will result in the climate parameter being closer to the set point for said appliance than if said appliance is inactive for the next running cycle; and if it is predicted that said appliance being inactive results in the climate parameter being closer to the set point, maintain said appliance in an inactive state for the next running cycle; if it is predicted that said appliance being active results in the climate parameter being closer to the set point, communicate with the controller to request permission to be in an active state for the next running cycle and receive from the controller a communication regarding the activation of the appliance for the next running cycle and set the status of the appliance for that running cycle accordingly, and wherein the controller is arranged to: store a cap for the total power consumption of the appliances; select some or all of said appliances which have requested permission to be active for the next running cycle such that said cap is not exceeded and taking account of the predicted deviation of each appliance from its set point if it is not activated; and communicate with said selected appliances to cause them to be active for the next running cycle.

The climate parameter may be, for example, temperature, humidity or airflow. The climate control appliances may be, for example, heaters, chillers, air conditioning units, humidifiers, driers, air vents or controllable window blinds.

By using a projection-based decision mechanism to determine the climate control appliances which are to be activated, it is possible to reduce or avoid unnecessarily "overshooting" of the set-point for any particular climate control appliance (which could result in both energy waste and discomfort). The projections made may take account of (inferable) thermal parameters of heat loss/gain rates from the area surrounding each appliance.

The building management system of this aspect can make use of dynamic and fine-grained local decision-making, informed by real-time sensor readings. This means that the building management system can take into account special, changing and/or unforeseen circumstances in individual rooms or areas, which cannot be done by applying a sequence of pre-calculated policies.

In a development of this aspect, as well as setting a power cap, it is also possible to set a discomfort threshold which if breached could be used to alert a central or wider building management system to enact other demand reduction strategies, which may include a general, or local relaxation of the cap.

The building management system of this aspect combines enhanced flexibility with a guarantee that the total load will not exceed a certain "cap" (limit or budget) by operating a two-level orchestration method. All local decisions can be aggregated and reviewed by a centralized controller with the authority to allow or deny activation of individual climate-control appliances. In effect, this secondary decision level can maintain and enforce what amounts to a dynamic, fully customizable policy taking into account local requirements yet simultaneously achieving a global target.

This building management system can be usefully included within a Demand Response (DR/DSM) context, since it provides a guaranteed cap of power consumption that which, once set, will not be exceeded by the system. The cap can also be dynamically adjusted if desired to meet time varying supply-side constraints.

Overall using the building management system of the present aspect is likely to lead to some overall energy savings as the climate parameter is allowed to drift during periods of power capping, reducing total consumption by the appliances. After using the building management system of this aspect for some time it may be discovered that apparent discomfort is in fact at an acceptable level in some zones, which could lead to longer term adjustments and energy savings becoming possible.

As it is based at an appliance level, the building management system of the present aspect can take into account the influence of external factors and variables (e.g. temperature) on the priority level of "competing" processes. By contrast, in the prior art, typically only the aggregated load/price was taken into consideration to determine if a particular process/load was allowed to start.

In a preferred embodiment, the controller is further arranged to: determine the total number of said appliances requesting permission to be in an active state for the next running cycle and check whether said cap is exceeded with all such appliances being in an active state; if it is not, communicate with each appliance requesting permission to cause said appliances to be active for the next running cycle; if it is, determine a subset of said appliances which can be active such that the cap is not exceeded and the overall deviation of said climate parameters from said set points is minimized and communicate with said subset of appliances to cause the appliances in said subset to be active for the next running cycle.

In a development of the above preferred embodiment the controller is arranged to determine said subset by: determining the number of said appliances which can be active without exceeding said cap; selecting, from the appliances requesting permission, the appliance whose predicted climate parameter at the end of the next running cycle if the appliance is inactive is furthest from the set point for said appliance, and adding said appliance to the subset; and repeating said selection for the remaining appliances requesting permission until the number of appliances in said subset has reached said determined number which can be active without exceeding said cap.

The process carried out by the controller in the above development is preferred over a combinatorial approach that attempts to consider the effect of all possible permutations of appliance activation as it is considerably simpler and therefore more efficient both computationally and in terms of time taken.

At least one of said appliances in the system of this aspect may further include an occupancy determination sensor which is arranged to determine the occupancy of an area served by said climate control appliance, and wherein either: the processor is further arranged to set said set point for said appliance based on said determination of occupancy; or the controller is arranged to take said occupancy into account when selecting if said appliance is to be active for the next running cycle. By determining the occupancy of an area or zone, it may be possible to identify areas or zones for which the climate control is not currently necessary. These zones could be given lower local caps, or given lower preference when determining the subset of appliances to be active in the next cycle (at one extreme, all appliances in that area could be switched off) and the remaining occupied zones have their caps increased accordingly. Alternatively the set point for appliances in zones with no occupancy could be set to a minimal level, such that demands to be active from such appliances are infrequent.

The system may also adjust said cap for one or more of said groups of appliances or removing said cap for one or more of said groups of appliances by incrementally increasing said cap over a predetermined period of time. In this way, the building management system may allow for a controlled relaxation of the cap. For example, after a period of power capping, the cap may be removed entirely. However, it may be desirable to avoid a rapid "rebound" which may result in an energy demand spike as a result of all (or a large proportion) of appliances switching on as soon as the cap is removed. Therefore the method may be arranged to remove a cap in stages by adjusting the capping level over a period of time.

The cap may be dynamically adjusted to match the demand level of said plurality of climate control appliances to a time-varying power supply level. A particular implementation of this would be to dynamically match demand levels to time-varying changes in supply levels from local renewable sources. The output from renewable energy sources (e.g. solar panels, wind generators) can be very variable and matching demand levels to those supply levels by dynamically varying the cap applied can maximise the use of those sources.

The system of this aspect preferably operates by carrying out a method according to the above described first aspect.

The system of the present aspect may include any combination of some, all or none of the above described preferred and optional features.

A building management system according to an embodiment of the present invention and operating a method according to a further embodiment of the present invention will now be described.

A Building Management System (BMS) is generally designed to orchestrate operation of a variety of appliances in order to meet certain targets (in terms, e.g., of power consumption and/or environmental conditions), usually specified in the form of policies.

The embodiments of the present invention provide methods for limiting (i.e. capping) the aggregated power load of a population of climate control appliances (such as heaters and/or air-conditioning units) to an arbitrary value, whilst minimizing deviation from target environmental conditions and hence inconvenience to the occupants of the building.

For the sake of clarity the embodiments described herein will solely relate to situations in which each climate control appliance is a heating device and the affected environmental condition is temperature. However, it will be understood that the same techniques could be readily applied to control other variables (or a combination of such variables) including, but not limited to, humidity or brightness, and to other appliances. It will also be understood that, in certain circumstances, it will be desired to keep the environmental condition in question above a certain level (e.g. the temperature when the predominant requirement is for heating of the building in a cold climate), whilst in other circumstances it will be desired to keep the environmental condition below a certain level (e.g. the temperature when the predominant requirement is for the cooling or air conditioning of a building in a hot climate). In certain implementations, the BMS may be adjustable to deal with both such conditions (or a plurality of such conditions), for example as a result of seasonal variations in temperature or humidity.

It will also be appreciated that the BMS may control other aspects of the building services which are unrelated to the climate control.

Figure 2:
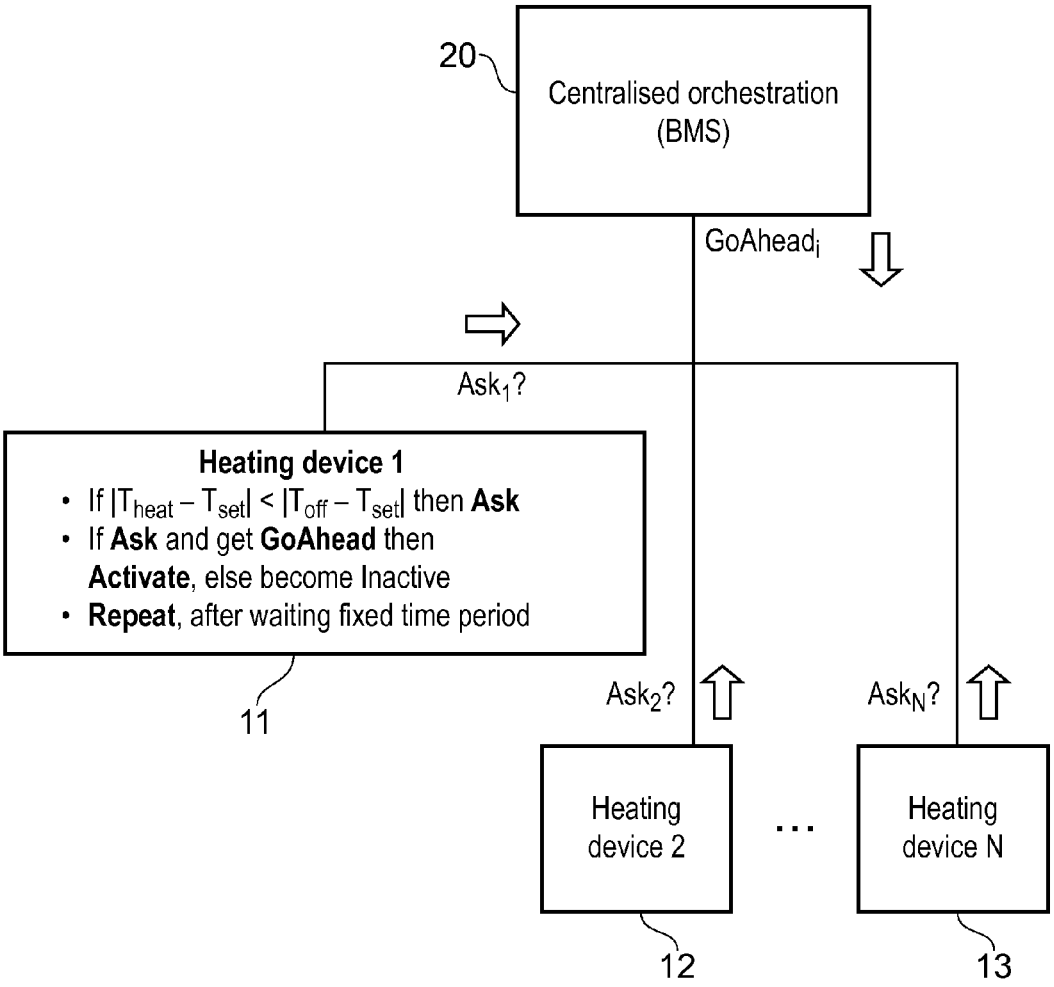
FIG. 2 shows the operation of a building management system according an embodiment of the present invention.

The operation of a building management system according to an embodiment of the present invention is shown schematically in FIGS. 1 and 2. FIG. 1 shows an arrangement of areas or rooms 1-8 which are, for the purposes of this example, distributed between two buildings. It will be appreciated that the number of rooms can differ in different embodiments of the invention, and in most cases will be considerably higher. Also, there is no requirement for the rooms to be located in two buildings; they can all be located within a single building or can be distributed across a number of buildings.

The building management system of the present embodiment combines distributed decision-making with centralized orchestration, informed by real-time sensor readings and known properties of specific areas. In the present embodiment, where we are considering heating appliances, these are temperature readings ($T_1 \ldots T_8$) and the intrinsic thermal properties of each area/room under the control of the BMS. These properties include the rate at which the area is heated by the climate control appliance (the heat gain coefficient $\gamma_1 \ldots \gamma_8$) and the rate at which it relaxes to the outside world temperature ($T_{out}$) if left uncontrolled (the heat loss coefficient $\lambda_1 \ldots \lambda_8$).

Every climate-control appliance makes an independent decision to switch on or off based on the expected (projected) deviation from its own target in either case after a certain period of (in)activity. For the purpose of orchestration, the decision of all controlled appliances is synchronized (e.g. triggered by an explicit signal from the BMS). FIG. 2 shows the general configuration of such a system.

A plurality of climate control appliances 11, 12, 13 (which in this embodiment are heating devices) are communicatively connected to a centralised building management system 20.

Instead of relying on a simple thermostat which would switch on the heater as soon as the temperature reading falls below a certain value and switch it off when exceeding it, each appliance determines whether running for a certain period (a running cycle) will bring the room/area around that device further or closer to the target than remaining inactive for the same amount of time. The device does so by applying a temperature model to the currently detected temperature in the room/area for the two alternative conditions of the device being active or inactive for the running cycle.

In the present embodiment, the temperature model used is to calculate $dT/dt=\lambda(T_{out}-T)+\gamma(T_c-T)$ for the situation when the heating device is active and to calculate $dT/dt=\lambda(T_{out}-T)$ for the situation when the heating device is inactive, where $T_{out}$ is the outside temperature and $\lambda$ is the heat loss coefficient which describes the rate of heat loss of the room to the external environment and $T_c$ is the temperature of the heat source and $\gamma$ is the heat gain coefficient which describes the effectiveness of the heat transfer from that heat source into a particular room (or zone within a building).

More detailed technical descriptions and temperature models are known. In the present embodiment, $\lambda$ and $\gamma$ are measured separately and recorded or communicated to each heating device. However, in alternative embodiments $\lambda$ and $\gamma$ can be estimated for a given room/zone.

Using the temperature model, the device calculates the temperature at the end of the running cycle under the two alternative scenarios: $T_{heat}$ if the device is active for the running cycle and $T_{off}$ if the device is inactive for the running cycle. The device then determines the absolute deviation of each of these alternatives from the desired temperature in the area/room (the "set-point" $T_{set}$). If the deviation in the scenario where the device is active is less than that if the device is inactive (i.e. $|T_{heat}-T_{set}|<|T_{off}-T_{set}|$) then the device "applies" to the BMS 20 for permission to become active by sending an "Ask" message to the BMS 20 and becomes a candidate for activation in the next cycle.

This process is repeated by all appliances connected to the BMS 20 at the end of each running cycle. The BMS 20 collates a list of the climate control units requesting activation based on their individual projections. Two situations can arise: either the total energy requirements for all of them is below the arbitrarily set target (the cap), or the aggregated load to operate all candidate appliances simultaneously exceeds the power limit.

In the first case, the obvious solution is to send a "go ahead" message to all requesting units. In the second, the BMS 20 uses a prioritization algorithm to determine which appliances are allowed to start and which are left in "standby" (inactive) for the next cycle.

Various methods can be used to prioritize which of the devices requesting activation should be allowed to do so whilst maintaining the cap.

An obvious, "brute force" approach would be to examine all possible activation patterns that satisfy the overall power constraint and select the one for which inconvenience is minimized. Note that several variables could be used to measure performance: e.g. it could be the average deviation from target, or it could be the highest deviation observed across all areas (in both cases: lower is better).

However, combinatory effects make this option impractical as soon as the number of controlled devices exceeds just a handful.

The alternative algorithm provided by the present embodiment is as follows: the BMS 20 first determines which area would suffer the worst penalty (deviation from the target climate condition set-point, e.g., for temperature, $|T_{off}-T_{set}|$), should the local climate control appliance not be allowed to switch on. A "go ahead" message is then sent to this device, and this operation is simply repeated until the next appliance would cause the cap to be exceeded, thereby observing the cap whilst prioritising operation of those appliances which contribute most to the occupants' comfort.

In the situation where the climate control appliances are, or can be assumed to be, homogeneous in respect of their power requirements when operational, a variation on the above algorithm can be provided in which the BMS 20 first computes the total number of devices (N) that can operate concurrently without exceeding the power limit. Then it determines which area would suffer the worst penalty (deviation from the target climate condition set-point, e.g., for temperature, $|T_{off}-T_{set}|$), should the local climate control appliance not be allowed to switch on. A "go ahead" message is then sent to this device, and this operation is simply repeated N times, thereby observing the cap whilst prioritising operation of those appliances which contribute most to the occupants' comfort.

Simulation results indicate that the above method provides virtually identical performance to the "brute force" approach".

In further embodiments, the system may also include occupation sensors (for example PIR devices) which could identify zones for which comfort control is no longer necessary. These zones could be given lower local caps, or given lower preference when determining the subset of appliances to be active in the next cycle (at one extreme, all appliances in that area could be switched off) and the remaining occupied zones have their caps increased accordingly. Alternatively the set point for appliances in zones with no occupancy could be set to a minimal level, such that demands to be active from such appliances are infrequent.

In other embodiments the system may allow for a controlled relaxation of a consumption cap. After a period of power capping (for example to meet a particular consumption target within a specified period), the cap may be removed entirely. However, it is often desirable to avoid a rapid "rebound" which may result in an energy demand spike as a result of all (or a large proportion) of appliances switching on as soon as the cap is removed. Therefore the system may be arranged to remove a cap in stages by adjusting the capping level over a period of time. For example, from a cap that may equate to 70% of appliances active, the system may increase the cap to a level corresponding to 80% of appliances active for the 30 minute period immediately after the cap has been removed and to 90% of appliances active for the next 30 minute period, before uncapped operation (i.e. operation driven only by the comfort parameter requirements) thereafter.

The system could also be used to dynamically match demand levels in the building to time-varying changes in supply levels from local renewable sources. The output from renewable energy sources (e.g. solar panels, wind generators) can be very variable and matching demand levels to those supply levels by dynamically varying the cap applied can maximise the use of those sources.

The system may provide for additional or alternative demand reduction initiatives when a threshold level of discomfort is reached (as measured by the climate parameter).

The system may also allow over-riding of the power cap in the event that a threshold discomfort level is reached, either in the building as a whole, or within a specified zone of a building. This provides for a trade-off in extreme climatic circumstances.

The systems and methods of the above embodiments may be implemented in a computer system (in particular in computer hardware or in computer software) in addition to the structural components and user interactions described.

The term "computer system" includes the hardware, software and data storage devices for embodying a system or carrying out a method according to the above described embodiments. For example, a computer system may comprise a central processing unit (CPU), input means, output means and data storage. Preferably the computer system has a monitor to provide a visual output display (for example in the design of the business process). The data storage may comprise RAM, disk drives or other computer readable media. The computer system may include a plurality of computing devices connected by a network and able to communicate with each other over that network.

The methods of the above embodiments may be provided as computer programs or as computer program products or computer readable media carrying a computer program which is arranged, when run on a computer, to perform the method(s) described above.

The term "computer readable media" includes, without limitation, any non-transitory medium or media which can be read and accessed directly by a computer or computer system. The media can include, but are not limited to, magnetic storage media such as floppy discs, hard disc storage media and magnetic tape; optical storage media such as optical discs or CD-ROMs; electrical storage media such as memory, including RAM, ROM and flash memory; and hybrids and combinations of the above such as magnetic/optical storage media.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

In particular, although the methods of the above embodiments have been described as being implemented on the systems of the embodiments described, the methods and systems of the present invention need not be implemented in conjunction with each other, but can be implemented on alternative systems or using alternative methods respectively.

The invention claimed is:

1. A method of limiting power consumption in a plurality of climate control appliances, each of which is communicably coupled to a controller, the climate control appliances having a running cycle of predetermined length, the method including the steps of:

setting a cap for the total power consumption of the appliances;

setting a set point for a climate parameter for each climate control appliance; and before the end of each running cycle, each climate control appliance:

measuring a climate parameter associated with the area around said climate control appliance;

predicting whether said appliance being active for the next running cycle will result in the climate parameter being closer to the set point for said appliance than if said appliance is inactive for the next running cycle; and if it is predicted that said appliance being inactive results in the climate parameter being closer to the set point, maintaining said appliance in an inactive state for the next running cycle without intervention from the controller;

if it is predicted that said appliance being active results in the climate parameter being closer to the set point, said appliance communicating with the controller to request permission to be in an active state for the next running cycle;

the controller:

selecting some or all of said appliances which have requested permission to be active for the next running cycle such that said cap is not exceeded and taking account of the predicted deviation of each appliance from its set point if it is not activated; and communicating with said selected appliances to cause them to be active for the next running cycle; and wherein the step of selecting includes the sub-steps of:

determining the total number of said appliances requesting permission to be in an active state for the next running cycle and checking whether said cap is exceeded with all such appliances being in an active state; and if said cap is not exceeded, communicating with each appliance requesting permission to cause said appliances to be active for the next running cycle;

if said cap is exceeded, determining a subset of said appliances which can be active such that the cap is not exceeded and the overall deviation of said climate parameters from said set points is minimized and communicating with said subset of appliances to cause the appliances in said subset to be active for the next running cycle; and wherein the step determining a subset of said appliances includes the sub-steps of:

selecting, from the appliances requesting permission, the appliance whose predicted climate parameter at the end of the next running cycle if the appliance is inactive is furthest from the set point for said appliance, and adding said appliance to the subset; and repeating said selection for the remaining appliances requesting permission until adding a further appliance to the said subset would cause the cap to be exceeded.

2. A building management system comprising a plurality of climate control appliances communicably coupled to a controller, each of the climate control appliances having a running cycle of predetermined length and a processor which is arranged to:

store a set point for a climate parameter associated with said appliance;

before said climate control appliance reaches the end of each running cycle:

measure a climate parameter associated with the area around said climate control appliance;

predict whether said appliance being active for the next running cycle will result in the climate parameter being closer to the set point for said appliance than if said appliance is inactive for the next running cycle; and if it is predicted that said appliance being inactive results in the climate parameter being closer to the set point, maintain said appliance in an inactive state for the next running cycle without intervention from the controller;

if it is predicted that said appliance being active results in the climate parameter being closer to the set point, communicate with the controller to request permission to be in an active state for the next running cycle and receive from the controller a communication regarding the activation of the appliance for the next running cycle and set the status of the appliance for that running cycle accordingly, and wherein the controller is arranged to:

store a cap for the total power consumption of the appliances;

select some or all of said appliances which have requested permission to be active for the next running cycle such that said cap is not exceeded and taking account of the predicted deviation of each appliance from its set point if it is not activated; and communicate with said selected appliances to cause them to be active for the next running cycle; and wherein the controller is further arranged to:

determine the total number of said appliances requesting permission to be in an active state for the next running cycle and check whether said cap is exceeded with all such appliances being in an active state;

if said cap is not exceeded, communicate with each appliance requesting permission to cause said appliances to be active for the next running cycle;

if said cap is exceeded, determine a subset of said appliances which can be active such that the cap is not exceeded and the overall deviation of said climate parameters from said set points is minimized and communicate with said subset of appliances to cause the appliances in said subset to be active for the next running cycle; and wherein the controller is arranged to determine said subset by:

selecting, from the appliances requesting permission, the appliance whose predicted climate parameter at the end of the next running cycle if the appliance is inactive is furthest from the set point for said appliance, and adding said appliance to the subset; and repeating said selection for the remaining appliances requesting permission until adding a further appliance to the said subset would cause the cap to be exceeded.

3. The method according to claim 1, further including the steps of:

determining the occupancy of an area served by at least one of said climate control appliances; and either:

setting said set point for said appliance based on said determination of occupancy, or taking said occupancy into account when selecting if said appliance is to be active for the next running cycle.

4. The method according to claim 1, further including the step of:

adjusting said cap or removing said cap by incrementally increasing said cap over a predetermined period of time.

5. The method according to claim 1, wherein the cap is dynamically adjusted to match the demand level of said plurality of climate control appliances to a time-varying power supply level.

6. The method according to claim 1, wherein said step of determining the subset is performed without taking into account historical states of the appliances.

7. The building management system according to claim 2, wherein at least one of said appliances further includes an occupancy determination sensor which is arranged to determine the occupancy of an area served by said climate control appliance, and wherein either: the processor is further arranged to set said set point for said appliance based on said determination of occupancy; or the controller is arranged to take said occupancy into account when selecting if said appliance is to be active for the next running cycle.

8. The building management system according to claim 2, wherein the controller is further arranged to adjust said cap or remove said cap by incrementally increasing said cap over a predetermined period of time.

9. The building management system according to claim 2, wherein the cap is dynamically adjusted to match the demand level of said plurality of climate control appliances to a time-varying power supply level.

10. The building management system according to claim 2, wherein the controller is arranged to determine said subset without taking into account historical states of the appliances.

* * * * *